US007883154B2

(12) United States Patent
Beach et al.

(10) Patent No.: US 7,883,154 B2
(45) Date of Patent: Feb. 8, 2011

(54) CUTTING TOOL WITH WATER INJECTION TO THE CUTTING BIT SHANK

(75) Inventors: Wayne H. Beach, Roaring Spring, PA (US); Stephen P. Stiffler, New Enterprise, PA (US); Eric P. Helsel, New Enterprise, PA (US); Donald E. Keller, Bedford, PA (US)

(73) Assignee: Kennametal Inc., Latrobe, PA (US)

( * ) Notice: Subject to any disclaimer, the term of this patent is extended or adjusted under 35 U.S.C. 154(b) by 320 days.

(21) Appl. No.: 12/200,260

(22) Filed: Aug. 28, 2008

(65) Prior Publication Data

US 2010/0052406 A1 Mar. 4, 2010

(51) Int. Cl.
*E21C 35/22* (2006.01)

(52) U.S. Cl. ..... 299/81.3

(58) Field of Classification Search ..... 299/81.1, 299/81.2, 81.3

See application file for complete search history.

(56) References Cited

U.S. PATENT DOCUMENTS 4,484,783 A 11/1984 Emmerich
4,537,448 A * 8/1985 Ketterer ..... 299/81.2
4,583,786 A * 4/1986 Thorpe et al. ..... 299/81.3
4,650,253 A 3/1987 Clemmow et al.
4,753,303 A 6/1988 Burr
4,786,111 A 11/1988 Yargici
4,915,454 A 4/1990 Southern
5,040,624 A 8/1991 Schumacher et al.
5,099,932 A 3/1992 Hixon
6,099,081 A 8/2000 Warren et al.
6,485,104 B1 11/2002 Keller
7,469,971 B2 * 12/2008 Hall et al. ..... 299/81.1
2007/0045009 A1 3/2007 Gien
2008/0035381 A1 2/2008 Hall et al.
2008/0035383 A1 2/2008 Hall et al.
2008/0035386 A1 2/2008 Hall et al.
2008/0036276 A1 2/2008 Hall et al.
2008/0036280 A1 2/2008 Hall et al.
2008/0048484 A1 2/2008 Hall et al.

* cited by examiner

*Primary Examiner*—John Kreck
(74) *Attorney, Agent, or Firm*—Matthew W. Smith

(57) ABSTRACT

A cutting tool assembly mounted on a rotating drum and having a base block, a wear sleeve and a cutting bit wherein a seal is located between the base block and wear sleeve is disclosed. A fluid passage spans from the rotating drum to a discharge location between the wear sleeve and the shank of the cutting bit. The fluid lubricates the shank of the cutting bit and bore of the wear sleeve allowing the cutting bit to rotate freely within the wear sleeve. Rotation of the cutting bit promotes even wear and long life of the bit.

13 Claims, 3 Drawing Sheets

CUTTING TOOL WITH WATER INJECTION TO THE CUTTING BIT SHANK

FIELD OF THE INVENTION

The present invention relates to tools and tool assemblies for mining and construction applications and, more particularly, is concerned with prolonging the life of the cutting tools in these applications.

BACKGROUND INFORMATION

Cutting tool assemblies for such applications as mining or road milling typically comprise a cutting tool, rotatably mounted within a support block. The support block in turn is mounted onto a drum, chain or other body, typically by welding, which in turn is driven by a suitable drive means. A number of such support blocks carrying cutting tools are mounted onto said drum to continually mine and remove material such as coal, rock, asphalt or concrete. The material removed by the cutting tool is pulverized by the cutting tool as each tip is rotated about the drum or chain into contact with the material. Some of the pulverized material collides against the support block and other cutting tool structure. The continual collision of cutting pick and material being removed causes abrasion and wear of the cutting tool and any other components mounted on or near the support block. The wear leads to eventual failure of the tool necessitating downtime of the associated equipment so the worn parts can be replaced.

Wear sleeves have been devised to help protect the front of support block and to provide easily replaceable wear components in comparison to the entire block. It is known to equip a cutting tool assembly with a spray nozzle for spraying fluid onto a cutting tool so as to cool the tool thereby lengthening tool life. It is also known that free rotation of a cutting bit within the support block of the cutting tool promotes tool life by promoting even wear of the cutting bit. Current cutting tool assemblies often affix a shank of the cutting bit within a bore or a wear sleeve of the support block or within the a bore of the support block so the bit can rotate within a bore. It is a common occurrence for the cutting bits to seize within the bore preventing free rotation of the cutting bit and causing premature failure of the cutting bit.

The present invention has been developed in view of the foregoing.

SUMMARY OF THE INVENTION

The present invention provides a cutting tool assembly including a support block, wear sleeve and cutting but which lubricates an interface of the cutting bit and the wear sleeve to promote even wear of the cutting bit thereby deterring premature failure of the cutting bit. A seal between the support block and the wear sleeve allows the fluid to pass from a passage in the support block to a passage in the wear sleeve. The wear sleeve passage discharges into a bore of the wear sleeve which holds a shank of the cutting bit. The fluid lubricates the space between the shank of the cutting bit and the bore of the wear sleeve. The lubrication promotes free rotation of the shank of the cutting bit within the bore of the wear sleeve.

An aspect of the present invention provides a cutting tool assembly for use in mining or road milling, comprising a support block having a bore and a fluid passage; a wear sleeve having a shank structured to fit at least partially within the bore of the support block, a collar, a bore for receiving a cutting bit and a fluid conduit, the fluid conduit extending from the collar to bore of the wear sleeve; and a seal located between collar of the wear sleeve and the support block, wherein the seal has at least one channel capable of delivering fluid from the fluid passage of the support block to the fluid conduit of the wear sleeve.

Another aspect of the present invention provides a method of lubricating a cutting tool assembly for use in mining and road milling comprising the steps of providing a cutting tool assembly with a support block, wear sleeve and cutting bit having a shank inserted into the wear sleeve and injecting a fluid between the wear sleeve and the shank of the cutting bit to lubricate the shank and permit the cutting bit to rotate.

Yet another aspect of the present invention provides a method of lubricating a cutting bit for use in mining and road milling comprising the steps of providing a cutting tool assembly having a support block with a fluid passage, a wear sleeve inserted into the support block having a bore and a fluid conduit having a discharge end in the bore, a seal between a shoulder of the wear sleeve and the support block, the seal having at least one opening to allow fluid to pass from the fluid passage of the support block to the fluid conduit of the wear sleeve, and a cutting bit having a shank inserted into the wear sleeve; providing fluid to the support block whereby the fluid is conveyed through the fluid passage of the support block, through at least one opening of the seal, through the fluid conduit of the wear sleeve and into the area between the shank of the cutting bit and the bore of the wear sleeve.

These and other aspects will become more apparent from the following description.

DETAILED DESCRIPTION

For purposes of the following detailed description, it is to be understood that the invention may assume various alternative variations and step sequences, except where expressly specified to the contrary. In this application, the use of the singular includes the plural and plural encompasses singular, unless specifically stated otherwise. In addition, in this application, the use of "or" means "and/or" unless specifically stated otherwise, even though "and/or" may be explicitly used in certain instances.

Figure 1:
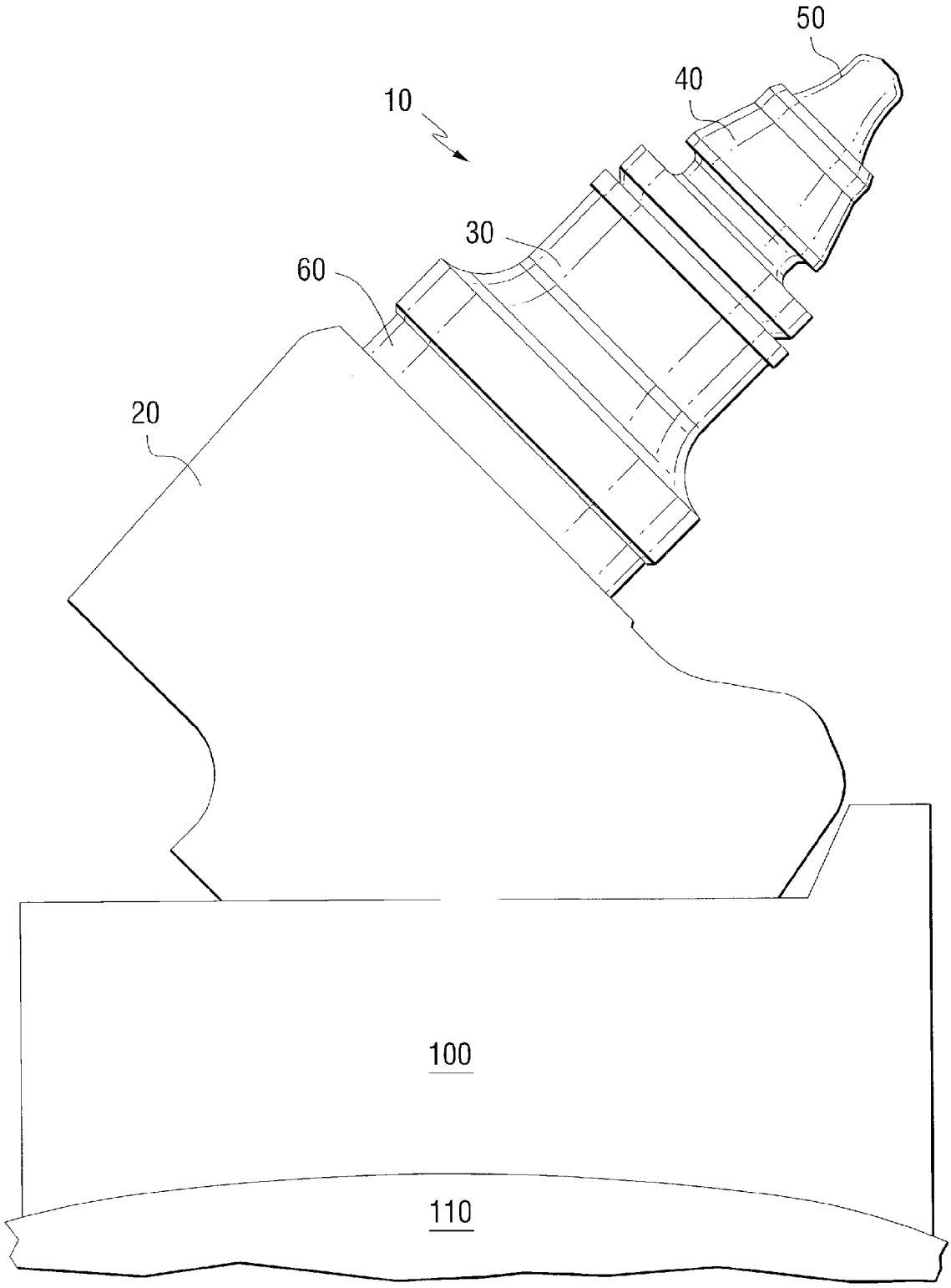
FIG. 1 is a side view of a cutting tool assembly mounted on a drum according to one embodiment of the present invention.

Referring now to FIG. 1, a cutting tool assembly 10 is shown according to one embodiment of the present invention. A support block 20 is structured and arranged to hold a wear sleeve 30. The wear sleeve 30, in turn, holds a cutting bit 40 which may have a hardened insert 50 at its tip. The hardened insert 50 often comprises a material such as cemented tungsten carbide, polycrystalline diamond or other suitable material. The supporting block 20 may be mounted on a pedestal 100 which may be mounted on a rotating drum 110. Alternatively, the support block 20 may be mounted directly onto the rotating drum 110. In either case, it will be appreciated by those skilled in the art that the pedestal or support block may be welded or otherwise mechanically fastened to a rotating drum 110.

Figure 2:
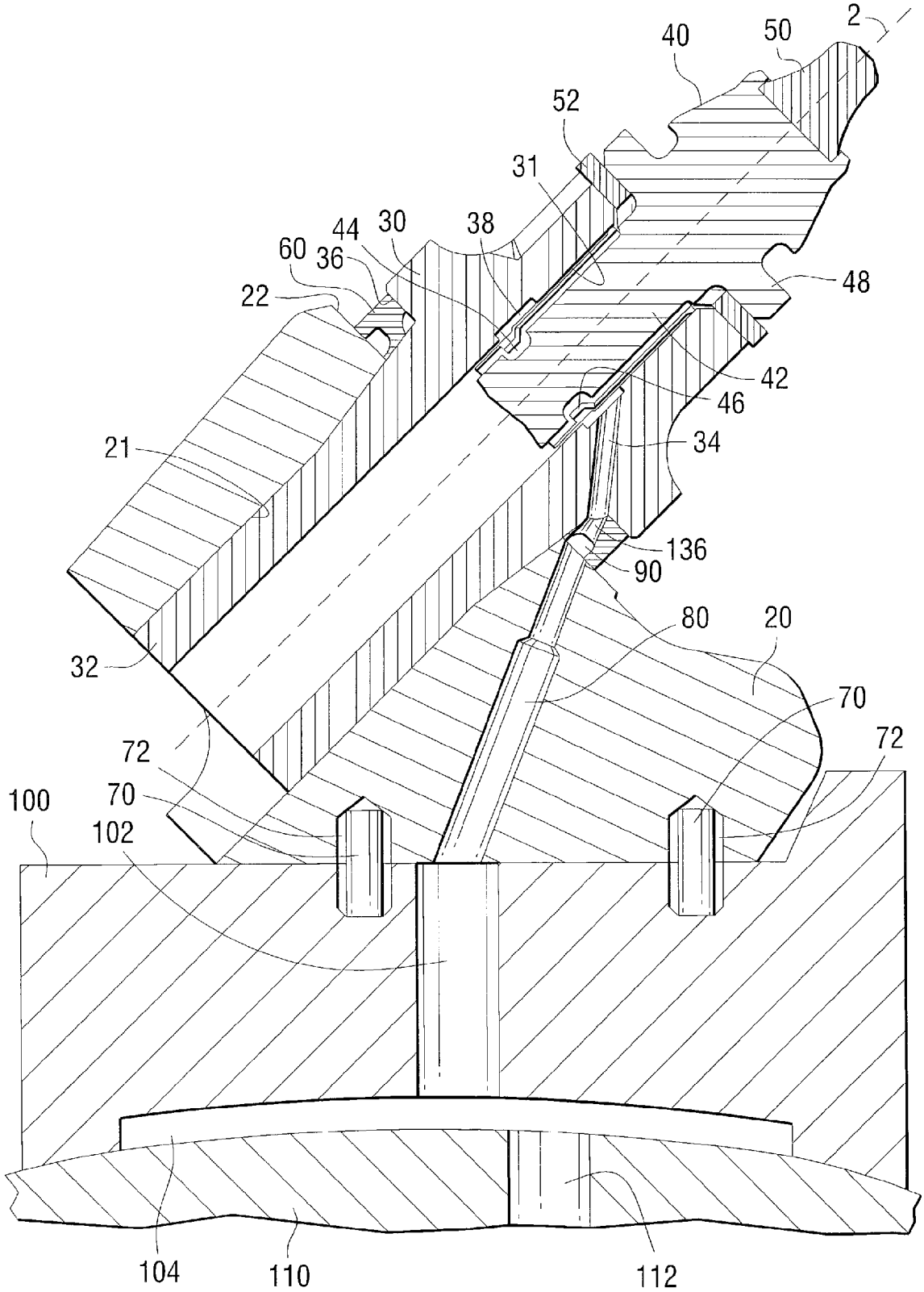
FIG. 2 is a cross-section view of the cutting tool assembly shown in FIG. 1 according to one embodiment of the present invention.

Referring now to FIG. 2, a cross-section of the cutting tool 10 of FIG. 1 is shown. A seal 60 separates a shoulder 36 of the wear sleeve 30 from the forward face 22 of the support block 20. As used herein, the term "seal" refers to a device or substance used to join two things together and/or make something impervious. The wear sleeve 30 may have a shank 32 which is retained within a bore 21 of the support block 20. The wear sleeve 30 may be secured in the bore 21 by any suitable means known to those skilled in the art, e.g., interference fit, mechanical fasteners and the like.

Still referring to FIG. 2, the cutting bit 40 has a shank 42 with an annular recess 44. The shank 42 of the cutting bit 40 is retained within a bore 31 of the wear sleeve 30. In this embodiment, the annular recess 44 engages a spring clip 46 mounted inside the wear sleeve 30. A washer 52 may separate the cutting bit collar 48 from the wear sleeve 30. It will be appreciated that the cutting bit shank 42, wear sleeve bore 31, and support block bore may be situated about a common longitudinal axis 2.

Referring again to FIG. 2, water or any suitable lubricating fluid passes from a source internal to the rotating drum 110 through a fluid passage 112 of the rotating drum 110. In certain respects, the fluid may be water with one or more treatments or additives such as a detergent. Fluid passage 112 is in fluid communication with a pocket 104 at the base of the pedestal 100. The pocket 104 allows fluid to pass from the fluid passage 112 to the fluid passage 102 of the pedestal 100. Mounting pins 70 may be used in conjunction with recesses 72 to ensure the support block 20 is properly aligned with pedestal 100. In this manner, a fluid passage 80 of the support block 20 aligns with the fluid passage 102 of the pedestal 100.

The fluid passage 80 of the pedestal 100 is in fluid communication with a distribution channel 90 of the seal 60. A series of openings 136 about the distribution channel 90 of the seal 60 allow fluid to pass to one or more fluid conduits 34 in the wear sleeve 30. The fluid conduit 34 extends from the seal 60 to the annular ring 38 of the wear sleeve 30. At this point, fluid can pass around the annular slot 38 of the wear sleeve 30 and recess 44 of the cutting bit 40, around the spring clip 46 and between the shank 42 of the cutting bit 40 and bore 31 of the wear sleeve 30 before exiting through the front or rear of the bore 31 of the wear sleeve 30. The fluid flow lubricates the area between the shank 42 and the bore 31 and helps to keep it free from dust and debris. This helps to keep cutting bit 40 rotating. Rotation of the cutting bit 40 promotes even wear and reduces the likelihood of premature bit failure.

Figure 3:
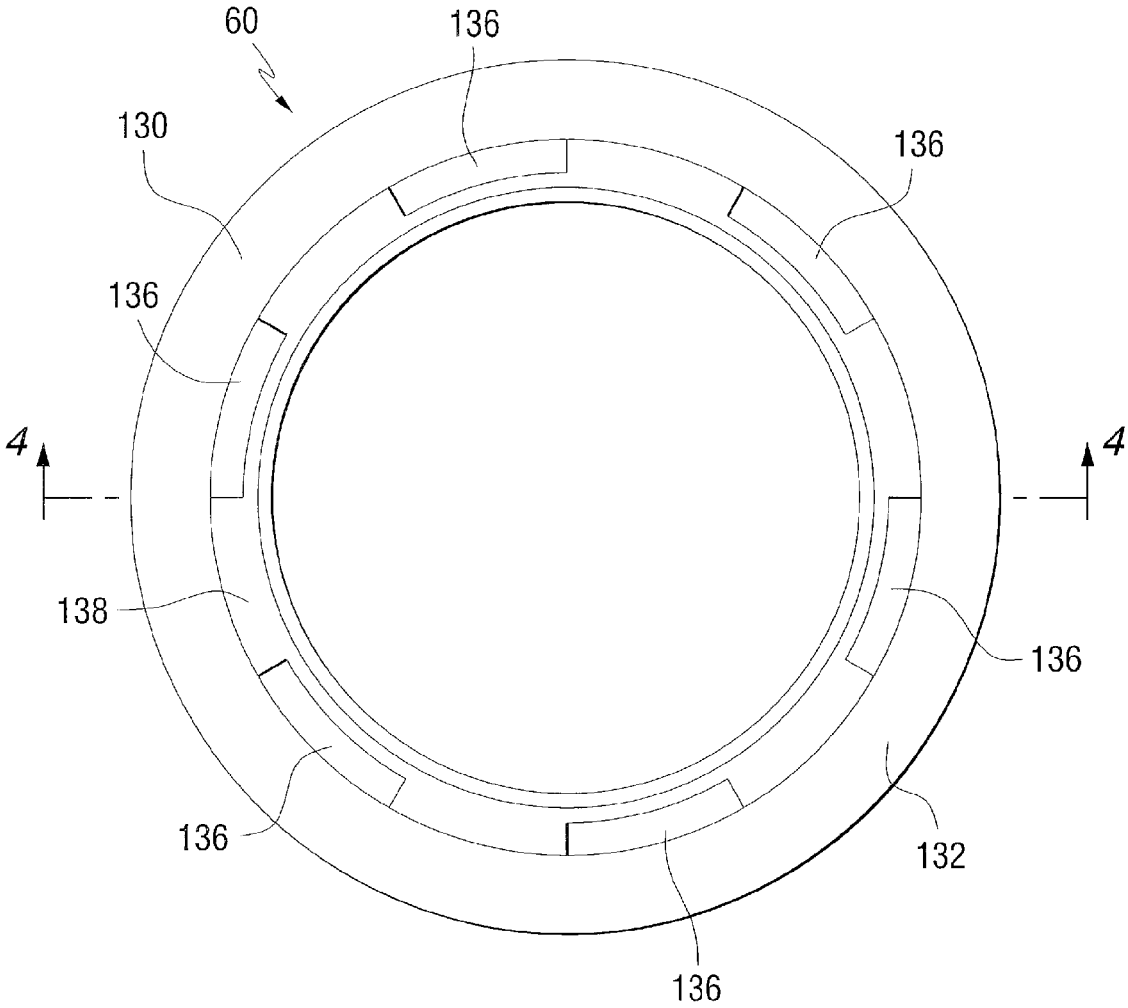
FIG. 3 is a top view of a seal for use with a cutting tool assembly according to one embodiment of the present invention.
Figure 4:
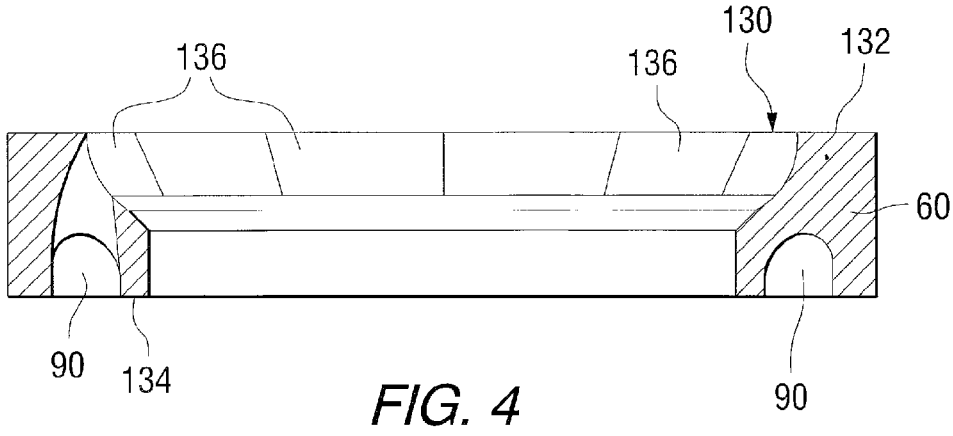
FIG. 4 is a section view of the seal of FIG. 3 along section line A-A according to one embodiment of the present invention.

A more detailed view of the seal 60 is shown in FIGS. 3 and 4 according to one embodiment of the present invention. FIG. 3 shows a top face 130 of the seal 60. The top face 130 of the seal 60 may have a top surface 132 which seats against the shoulder 36 of the wear sleeve 30. A bottom surface 134 of the seal 60 may seat against the shoulder 22 of the support block 22. The annular distribution channel 90 which is in the bottom surface 134 of the seal 60 opposite the depressions 136 receives fluid from fluid passage 80 of the support block 20. As mentioned above, openings 136 intersect the annular distribution channel 90 at one or more locations. The openings 136 extend to the top face 130 of the seal 60 and transfer fluid from the annular distribution channel 90 to the fluid conduit 34.

In certain respects, the seal 60 is made from polyurethane, nitrile rubber, fluoroelastomer, ethylene propylene, natural rubber, silicone rubber, poly(tetrafluoroethene) (PTFE), polyoxymethylene and like material. In other respects, the seal is a metallic material. Although the seal 60 is shown, as an annular ring coaxially located about the shank of the wear sleeve, it is contemplated that the seal may be any suitable configuration for delivering fluid from the support block to the wear sleeve. For example, instead of extending around the shank of the wear sleeve, the seal may be entirely located adjacent shank of the wear sleeve and the fluid passage of the support block and the fluid conduit of the wear sleeve.

Whereas particular embodiments of this invention have been described above for purposes of illustration, it will be evident to those skilled in the art that numerous variations of the details of the present invention may be made without departing from the invention as defined in the appended claims.

The invention claimed is:

1. A cutting tool assembly for use in mining or road milling, comprising:

a support block having a forward face, a bore and a fluid passage;

a wear sleeve having a shank structured to fit at least partially within the bore of the support block, a collar, a bore for receiving a cutting bit and a fluid conduit, the fluid conduit extending from the collar to bore of the wear sleeve; and a seal located between collar of the wear sleeve and the forward face of the support block, wherein the seal has at least one channel capable of delivering fluid from the fluid passage of the support block to the fluid conduit of the wear sleeve.

2. The cutting tool assembly for use in mining and road milling according to claim 1, further comprising a cutting bit having a shank structured to fit at least partially with the bore of the wear sleeve.

3. The cutting tool assembly for use in mining and road milling according to claim 1, wherein the seal is coaxially disposed about the shank of the wear sleeve.

4. The cutting tool assembly of for use in mining and road milling according to claim 1, wherein the seal comprises polyurethane, nitrile rubber, silicone rubber, natural rubber, fluoroelastomer, ethylene propylene, PTFE or polyoxymethylene.

5. The cutting tool assembly for use in mining and road milling according to claim 1, wherein the seal further comprises an annular distribution ring in a bottom surface of the seal and at least one opening extending from the distribution ring to a top surface of the seal.

6. The cutting tool assembly for use in mining and road milling according to claim 2, wherein the cutting bit further comprises a spring clip which retains the cutting bit shank within the bore of the wear sleeve.

7. A method of lubricating a cutting tool assembly for use in mining and road milling comprising the steps of:

providing a cutting tool assembly with a support block, wear sleeve and cutting bit having a shank inserted into the wear sleeve and injecting a fluid to a space between the wear sleeve and the shank of the cutting bit to lubricate the shank and permit the cutting bit to rotate, wherein the cutting tool assembly further comprises a seal between the wear sleeve and the cutting bit, wherein the fluid passes from the drum through the pedestal, through the support block, through the seal, and through the wear sleeve before it is injected into the space between the wear sleeve and the shank of the cutting.

8. The method of lubricating a cutting tool assembly for use in mining and road milling of claim 7, wherein the fluid comprises water.

9. A method of lubricating a cutting bit for use in mining and road milling comprising the steps of:

providing a cutting tool assembly having a support block with a fluid passage, a wear sleeve inserted into the support block having a bore and a fluid conduit having a discharge end in the bore, a seal between a shoulder of the wear sleeve and the support block, the seal having at least one opening to allow fluid to pass from the fluid passage of the wear support block to the fluid conduit of the wear sleeve, and a cutting bit having a shank inserted into the wear sleeve;

providing fluid to the support block whereby the fluid is conveyed through the fluid passage of the support block, through the at least one opening of the seal, through the fluid conduit of the wear sleeve and into the area between the shank of the cutting bit and the bore of the wear sleeve.

10. The method of lubricating a cutting bit for use in mining and road milling of claim 9, wherein the seal comprises polyurethane, nitrile rubber, silicone rubber, natural rubber, fluoroelastomer, ethylene propylene, PTFE or polyoxymethylene.

11. The method of lubricating a cutting bit for use in mining and road milling of claim 9, wherein the cutting tool assembly is mounted on a pedestal.

12. The method of lubricating a cutting bit for use in mining and road milling of claim 11, wherein the pedestal is mounted on a rotating drum.

13. The method of lubricating a cutting tool assembly for use in mining and road milling of claim 7, wherein the fluid comprises water.

* * * * *